United States Patent [19]

Schulze et al.

[11] 4,343,334

[45] Aug. 10, 1982

[54] JEANS FABRIC COMPRISING OPEN SHEATH CORE FRICTION SPUN YARNS AND PROCESS FOR ITS MANUFACTURE

[75] Inventors: Christian Schulze, Hattersheim am Main; Hans-Joachim Plein, Kelkheim, both of Fed. Rep. of Germany

[73] Assignee: Hoechst Aktiengesellschaft, Frankfurt am Main, Fed. Rep. of Germany

[21] Appl. No.: 201,798

[22] Filed: Oct. 29, 1980

[30] Foreign Application Priority Data

Sep. 25, 1980 [DE] Fed. Rep. of Germany ..... 3036069

[51] Int. Cl.[3] ..... B65H 71/00; D02G 3/36; D03D 15/00

[52] U.S. Cl. ..... 139/420 R; 28/166; 57/5; 428/255

[58] Field of Search ..... 139/420 R; 428/225; 57/5; 28/166

[56] References Cited

U.S. PATENT DOCUMENTS

| | | | |
|---|---|---|---|
| 3,439,491 | 4/1969 | Scruggs | 57/5 |
| 4,056,924 | 11/1977 | Umiastowski | 57/5 |
| 4,083,173 | 4/1978 | Ortzl et al. | 57/5 |
| 4,130,983 | 12/1978 | Domnann et al. | 57/5 |
| 4,241,571 | 12/1980 | Turk et al. | 57/5 |
| 4,249,368 | 2/1981 | Fehrer | 57/5 |
| 4,253,297 | 3/1981 | Pacholski et al. | 57/5 |
| 4,274,250 | 6/1981 | Lippmann | 57/5 |

FOREIGN PATENT DOCUMENTS

| | | | |
|---|---|---|---|
| 54-112264 | 9/1979 | Japan | 28/166 |
| 54-112265 | 9/1979 | Japan | 28/166 |

*Primary Examiner*—James C. Cannon

*Attorney, Agent, or Firm*—Curtis, Morris & Safford

[57] ABSTRACT

A jeans fabric consists of polyester fibers and of cotton in which the filling yarn is a polyester yarn or a polyester fiber/cotton mixed yarn and in which the warp has been dyed and the filling has not been dyed. At least the warp consists of a sheath-core staple fiber yarn manufactured by the open end sheath-core friction spinning process. The polyester fibers are disposed predominantly in the core, the cotton in the sheath of the warp yarn. The jeans fabric combines good wear resistance with an attractive handle.

8 Claims, No Drawings

JEANS FABRIC COMPRISING OPEN SHEATH CORE FRICTION SPUN YARNS AND PROCESS FOR ITS MANUFACTURE

The invention relates to a jeans fabric consisting of polyester fibers and cotton and containing, at least in the warp, a polyester-cotton mixed yarn. The invention also relates to a process for the manufacture of a jeans fabric.

Jeans fabrics are fabrics having a twill construction, which are also described as denim. Broken twill is also often used. Trousers, skirts, shirts, suits and similar articles are manufactured from these fabrics.

About 80% of the jeans fabrics or jeans articles on the market nowadays consist of 100% cotton. However, jeans fabrics which, in addition to cotton, contain a certain proportion of synthetic fibers, in most cases polyester fibers, have also been disclosed already, for example in German Utility Model No. 7,636,837.

In most cases jeans fabrics are only dyed in the warp. In order to achieve a good wash-out effect, it is necessary to use the expensive dyestuff indigo for dyeing. In the case of yarns consisting of 100% cotton, the dyestuff uptake or consumption is high.

In order to keep the consumption of dyestuff within limits, it is necessary to take special measures when dyeing.

If normal polyester-cotton staple fiber mixed yarns are used, it is also necessary to dye the polyester fiber, since otherwise the appearance of the goods becomes too milky. Expensive measures are also required, as disclosed in German Utility Model No. 7,636,837, in order also to achieve a good paling effect on scuffing when using such yarns.

The object of the present invention is therefore to provide a jeans fabric which avoids these disadvantages.

A further object of the invention is to produce goods having a handle which is extremely attractive and kind to the skin, by using a relatively large proportion of synthetic fibers, which are generally known to have great advantages.

These objects are achieved by means of a jeans fabric which consists of at least 40% by weight of polyester fibers and at least 10% by weight of cotton and in which the filling yarn is a polyester yarn or a polyester fiber/-cotton mixed yarn and in which the warp has been dyed and the filling has not been dyed, wherein at least the warp consists of a sheath-core spun fiber yarn manufactured by the open end sheath-core friction spinning process, in which yarn the polyester fibers are disposed predominantly in the core, while the cotton fibers are disposed predominantly in the sheath, of the warp yarn.

The jeans fabric according to the invention is manufactured by spinning polyester fibers and cotton to form a polyester-cotton mixed yarn for the filling, if appropriate dyeing the warp yarn and weaving in a twill construction. For the manufacture of the warp yarn an open end sheath-core friction spinning process is used, wherein at least 20% by weight, relative to the cross-section of the yarn, is employed for the sheath of the warp yarn, and the % by weight of cotton used in the sheath is $$A \geqq 0.0041\,(S-37)^2+90.5,$$

relative to the mixture of fibers in the sheath fabric which, as indicated in claims 1 to 4, is characterized, or has been manufactured, as indicated in claim 5.

The fibers employed for the manufacture of the jeans fabrics according to the invention are, in addition to cotton, polyester fibers, particularly fibers consisting predominantly of polyethylene terephthalate, which, however, does not exclude other polyester fibers and the known copolyester fibers.

The polyester fibers have a staple length and a denier such as is generally met with in polyester-cotton grades. This provides the advantage of employing a coarser denier for goods having a stiff handle and a finer denier for softer goods. This effect on the handle is not possible in the case of fabrics consisting solely of cotton or containing only a little synthetic fiber. The jeans fabric according to the invention contains 40% by weight to 90% by weight of polyester fibers and 10% by weight to 60% by weight of cotton fibers.

The warp yarns for the jeans fabric according to the invention are manufactured on an open end sheath-core friction spinning frame, for example a device such as those disclosed in German Utility Model No. 7,806,318 and other publications. In total, 40% by weight to 80% by weight of polyester fibers and 20% by weight to 60% by weight of cotton are used for the manufacture of these yarns. In accordance with the invention, at least 20% by weight of the total quantity of fiber is employed in the sheath of the yarn. The remainder forms the core of the yarn. The sheath of the warp yarn contains more cotton than does the core of the yarn, but preferably:

$$A \geqq 0.0041\,(S-37)^2+90.5$$

% by weight of cotton, relative to the fiber mixture in the sheath, A indicating the proportion of cotton fibers in the yarn sheath in % by weight and S denoting the proportion of polyester fibers in the whole warp yarn in % by weight.

The polyester fibers used in the sheath of the warp yarn have a denier between 0.8 and 1.7 dtex, preferably between 1.0 and 1.2 dtex. The addition of these fibers produces a particularly attractive handle in the jeans fabric according to the invention.

The filling yarn employed can be 100% polyester fiber yarns or polyester-cotton mixed yarns, but yarns such as have already been described for the warp are preferred. In cases where the material comes into contact with the human skin, an extremely agreeable feeling when being worn is imparted by the use, in accordance with the invention, of the last-mentioned yarns in the filling also.

In this context, polyesters are the high-molecular compounds which are composed essentially of terephthalic acid units and glycol units, preferably of terephthalic acid units and ethylene glycol units. Other bifunctional compounds can be incorporated in both the acid component and in the alcohol component, up to 15%, relative to the units. It is also advantageous for butylene glycol units to be present instead of the ethylene glycol units. The warp yarns to be used are normally dyed in the warp and a twill or broken twill is subsequently manufactured in a known manner. If the filling consists of 100% polyester fibers, it is also possible to carry out piece-dyeing of the jeans fabric, the cotton component being dyed in this process.

The invention will be illustrated further by means of examples.

EXAMPLES

1. A sheath-core yarn of denier 1,000 dtex is manufactured on an open end sheath-core friction spinning frame. The sheath:core ratio is 48:52 parts by weight. The yarn core fed to the spinning frame is 48 parts by weight per unit time of a roving consisting of pure polyethylene terephthalate fibers, 1.7 dtex/38 mm. A fiber mixture consisting of 50 parts by weight of cotton and 2 parts by weight of polyethylene terephthalate fibers, 1.3 dtex/38 mm. is fed to the spinning frame, per unit time, via the dissolving device for forming the yarn sheath. The yarn intended for the warp of the fabric is beamed and dyed in the warp with cotton dyestuffs. The same yarn, but undyed, is used as the filling and a twill is manufactured.

The fabric, according to the invention, manufactured in this way has an excellent handle and is extremely agreeable to wear next to the skin.

2. Using the same yarn as in Example 1, and undyed warp is manufactured, but the filling yarn employed is, however, a yarn of denier 1,000 dtex, consisting of 100% polyethylene terephthalate fibers, 1.7 dtex/38 mm, and a twill is woven. The cotton component of the warp yarn is dyed in the piece.

This fabric too exhibits an outstanding appearance and an excellent handle.

We claim:

1. Jeans fabric which consists of at least 40% by weight of polyester fibers and at least 10% by weight of cotton and in which the filling yarn is a polyester yarn or a polyester fiber/cotton mixed yarn and in which the warp has been dyed and the filling has not been dyed, wherein at least the warp consists of a sheath-core staple fiber yarn manufactured by the open end sheath-core friction spinning process, in which yarn the polyester fibers are disposed predominantly in the core, while the cotton fibers are disposed predominantly in the sheath, of the warp yarn.

2. Jeans fabric according to claim 1, wherein the sheath of the warp yarn is at least 20% by weight, relative to the cross-section of the yarn, and contains a proportion of cotton fiber amounting to $$A \geqq 0.0041\,(S-37)^2+90.5$$

% by weight, wherein S denotes the proportion, in percent by weight, of polyester fibers in the whole warp yarn.

3. Jeans fabric according to either of claims 1 and 2, wherein the polyester fibers present in the sheath of the warp yarn have a denier of 0.8 to 1.7 dtex.

4. Jeans fabric according to claim 1, which contains filling yarns which have been constructed similarly to the warp yarns.

5. Jeans fabric of warp and undyed filling yarns comprising at least 40% by weight polyester fibers and at least 10% by weight cotton wherein the warp consists of a dyed sheath-core friction spun staple fiber yarn in which the core is predominantly of polyester fibers and the sheath is predominantly of cotton fibers.

6. Jeans fabric as defined in claim 5 wherein the filling is likewise a sheath-core staple fiber yarn in which the core is predominantly of polyester fibers and the sheath is predominantly of cotton fibers.

7. Jeans fabric as defined in claim 5 wherein the filling is a yarn of polyethylene terephthalate fibers.

8. Process for the manufacture of a jeans fabric according to claim 1 by spinning polyester fibers and cotton to form a polyester-cotton mixed yarn for the warp and a polyester yarn or polyester-cotton mixed yarn for the filling, dyeing the warp yarn and weaving in a twill construction, wherein an open sheath-core friction spinning process is used in the manufacture of the warp yarn, at least 20% by weight, relative to the cross-section of the yarn, is employed for the sheath of the warp yarn, and the % by weight of cotton used in the sheath is $$A \geqq 0.0041\,(S-37)^2+90.5,$$

relative to the mixture of fibers in the sheath.

* * * * *